US008006745B2

(12) United States Patent
Gerlach et al.

(10) Patent No.: US 8,006,745 B2
(45) Date of Patent: Aug. 30, 2011

(54) MOLDING MATERIAL MIXTURE, MOLDED PART FOR FOUNDRY PURPOSES AND PROCESS OF PRODUCING A MOLDED PART

(75) Inventors: Ralf-Joachim Gerlach, Krefeld (DE); Bettina Wehren, Goch-Hassum (DE)

(73) Assignee: Minelco GmbH, Essen (DE)

( * ) Notice: Subject to any disclaimer, the term of this patent is extended or adjusted under 35 U.S.C. 154(b) by 732 days.

(21) Appl. No.: 12/137,822

(22) Filed: Jun. 12, 2008

(65) Prior Publication Data

US 2008/0314549 A1 Dec. 25, 2008

(30) Foreign Application Priority Data

Jun. 12, 2007 (DE) ..... 10 2007 027 577

(51) Int. Cl.
*B22C 1/02* (2006.01)
*B22C 9/00* (2006.01)

(52) U.S. Cl. ..... 164/523; 164/349

(58) Field of Classification Search ..... None
See application file for complete search history.

(56) References Cited

U.S. PATENT DOCUMENTS 5,641,015 A 6/1997 Challand
7,712,516 B2 * 5/2010 Gerlach ..... 164/529

FOREIGN PATENT DOCUMENTS

DE 10 2004 042 535 3/2006
EP 109 5719 5/2001

* cited by examiner

*Primary Examiner* — Jessica L Ward
*Assistant Examiner* — Steven Ha
(74) *Attorney, Agent, or Firm* — Nils H. Ljungman & Associates

(57) ABSTRACT

A molding material mixture for foundry purposes, comprising a mold sand, a sodium hydroxide solution, an alkali-silicate binding agent, and an additive suspension. The molding material mixture contains 0.1 to 10% by weight of sodium hydroxide solution with reference to the weight of the sand, 0.1 to 5% of binding agent with a solid matter percentage of 20 to 70%, and 0.1 to 3% by weight of the additive suspension. The additive suspension comprises 30 to 70% by volume of an amorphous, spherical $SiO_2$ particles, which have a first grain size in the range of 1 to 5 micrometers, and a second grain size in the range of 0.01 to 0.05 micrometers.

20 Claims, 8 Drawing Sheets

MOLDING MATERIAL MIXTURE, MOLDED PART FOR FOUNDRY PURPOSES AND PROCESS OF PRODUCING A MOLDED PART

BACKGROUND

1. Technical Field

This application relates to a molding material mixture for foundry purposes, comprising a mold sand, a sodium hydroxide aqueous solution, a binding agent based on alkali silicate and additives. This application also relates to a molded part intended for foundry purposes and produced by using the molding material mixture. This application further relates to a process of producing a molded part.

2. Background Information

Molding material mixtures of the initially mentioned type are known from German patent application DE 102004042535 A1 (AS LÜNGEN GmbH) for example, wherein the binding agent is used in the form of an alkali water glass in connection with a particle-shaped metal oxide, for example silicon oxide, aluminum oxide, titanium oxide or zinc oxide in order to improve the strength of casting molds both immediately after molding and precipitation and also after storage and exposure to an increased amount of air humidity. The particle size of the metal oxides preferably amounts to less than 300 μm. According to the examples, the screen residue on a screen with a mesh width of 63 μm amounts to less than 10 percent by weight, preferably less than 8 percent by weight.

A further process of producing molding material mixtures whose purpose it is to achieve a high strength when combined with a polyphosphate- or borate-containing binding agent is described in U.S. Pat. No. 5,641,015. In column 4, line 39 of the U.S. patent it is mentioned that, as a result of a drying process making use of polyphosphate- or borate-containing binding agent, there is released water which is absorbed by adding silicon dioxide in the finest possible particles. This silicon dioxide consists of porous primary particles which are produced by a precipitation process, which particles comprise a grain size ranging between 10 and 60 nm, and which are agglomerated into secondary particles with a particle size of several μm (column 3, lines 64-66 of the U.S. patent).

An inorganic binding agent system for molding materials is described in European Patent 1095719B1, according to which, in the case of a binding agent based on alkali silicate with added sodium hydroxide aqueous solution, it is possible to improve the flow resistance by adding 8-10 percent by mass with reference to the binding agent. This improvement was accompanied by a higher moisture content of the core sand.

In addition to prior art measures of improving the strength value, more particularly the bending strength of molded parts, it is necessary to take into account further influencing factors which determine the quality of a molding material mixture, as discussed below.

Most importantly, it is necessary to mention flowability, which is known as a significant parameter for the suitability of the molding material when filling a core shooting machine.

Further important parameters are the precipitation curve and the reduction in sensitivity to air humidity.

However, the main quality characteristic to be achieved by the molding material mixture is the surface quality of the casting. Unfortunately, under the conditions prevailing in mass production, the prior art processes are not sufficiently stable, so that again and again, the reject quotas and the unacceptable additional costs due to the need for re-treatment are too high. The most suitable standard for assessing the surface quality has been found to be the determination of the surface percentage of sand adhesions on the casting.

OBJECT OR OBJECTS

It is therefore the object of at least one embodiment of this application to provide a new molding material mixture for foundry purposes and a molded part which can be produced by means of a simple drying process wherein the above-mentioned criteria, i.e. good flowing characteristics, a high bending strength and a high precipitation speed can be achieved, and wherein, at the same time, the surface quality measured by determining the surface percentage of sand adhesions can be improved considerably.

SUMMARY

It has been found that the use of an additive consisting of or consisting essentially of or comprising amorphous, spherically formed silicon dioxide achieves the desired advantages if the silicon dioxide grains in the form of the finest or very fine particles are added in two close grain spectra in approximately identical or very close volume percentages in the form of a suspension, wherein said suspension is uniformly distributed in the molding material mixture and the subsequent drying process results in a specifically designed sub-structure.

It has further been found that the use of an additive consisting of amorphous, spherically formed silicon dioxide achieves the desired advantages if the silicon dioxide grains in the form of the finest particles are added in two close grain spectra in approximately identical volume percentages in the form of a suspension, with a decisive measure consisting in that said suspension is uniformly distributed in the molding material mixture and that the subsequent drying process results in a specifically designed sub-structure.

At least one embodiment of the distribution and drying measures are disclosed herein, with further measures being described as process stages in accordance with at least one possible embodiment. In accordance with at least one embodiment, care should be taken to promote or ensure that no, virtually no, or very little agglomeration of the finest or very fine particles takes place during mixing, but that, on the contrary, in the respective grain classification there takes place a uniform or virtually uniform distribution of the particles. For this purpose, in at least one possible embodiment, fluid mixers and, amongst these, vane mixers have been found to be suitable under conditions of permanent or semi-permanent operation.

When producing the sub-structure, the drying process exerts a major influence on the formation of the roughnesses on the surface of the molded parts. In at least one possible embodiment, the distribution of the peak and valley structure may be influenced in such a way that there is achieved a relief structure which comprises a peak/valley differential ratio of a maximum of 300 nm. The drying processes can be both thermal drying and microwave drying, and even under extreme storage conditions at an air humidity in excess of 78% and storage temperatures in excess of 33° C. it was possible to achieve very good storage characteristics, even without the use of microwave oven drying.

During the drying process, the binding agent layer existing in the molding material mixture on the particles shrinks while there is formed a sub-structure of peaks and valleys. By means of successive pre-shrinking and subsequent shrinking, there is formed a substructure morphology which is characterized by a peak-valley difference of a maximum of 300 nm as a result of the crack formation during the two-stage shrinking process. During the physical drying process used in the first stage, energy is introduced directly into the moist binding agent envelope. The resulting strengthening of the binding agent envelope (surface), as a result of the subsequent thermal drying process, leads to the formation of cracks in the nano range (sub-structure).

In the subsequent examples, at least one possible embodiment is described and compared to other molding material mixtures and the resulting molded parts. For standardizing purposes, it was decided to use identical or virtually identical basic mixtures of Haltern mold sand with a mean grain size of 0.32 mm (Haltern Silica Sand H32, produced by Quarzwerke GmbH, Kaskadenweg 40, D-50226 Frechen, Germany). The grain size was determined according to *Gisserei Lexicon* (Foundry Lexicon) by Brunhuber, 16th edition, page 400 (*Giesserei Lexicon,* 1994 edition, 16th printing, editor Dipl.-Ing. Ernst Brunhuber, publisher Schiele & Schoen). The additive used was a suspension according to at least one possible embodiment containing 25% by volume of nano$SiO_2$ and 25% by volume of micro$SiO_2$ as well as 50% by volume of water.

Flowability is expressed as GF flowability (Georg Fischer Flowability test Type PFB); it was determined according to Brunhuber, 16th edition, pages 352/353.

The test specimens were standard test specimens measuring 22.5×22.5×180 mm which were subjected to the respective test conditions.

To summarize: it was possible to convincingly establish the improvements of the composition of the molding material mixture in accordance with at least one possible embodiment in respect of flowability and a reduction in degree of moisturizing relative to liquid aluminum. As liquid aluminum when used in the casting process comprises greatly moisturizing properties relative to silicon dioxide and, more particularly, is inclined to moisturize $SiO_2$ completely and penetrate intermediate spaces, it was highly surprising that it was possible that, with the molded part in accordance with at least one possible embodiment, only very small surface regions of less than 10% occurred where sand was adhering.

In combination with an alkali water glass binding agent which is uniformly distributed on the mold sand particles, it was possible to produce a molding material mixture based on quartz sand, which, in respect of its flowability, bending strength and precipitation, far exceeded the properties of prior art products, provided the additive was used in the two grain size classifications as disclosed herein with respect to at least one possible embodiment.

In the prepared molding material mixture, the micrometer-sized, amorphous $SiO_2$ spheres are to space the individual molding sand grains from one another while allowing same to slide off one another more easily. This "roller-skate effect" was confirmed by flowability measurements, for instance by the drastically decreasing stirring resistance while the suspension composed in accordance with at least one possible embodiment and comprising two different grain classifications is introduced into a blade mixer. In the process, power absorption of the vane mixer dropped by more than 50%, whereas the effect without an additive was less than 10% with reference to the power absorption before the additive was added.

As far as the mixing process is concerned, it is important to note the metering sequence of the individual components and their mixing period. The metering sequence is as follows: 1. The quartz sand is mixed with sodium solution. 2. An alkali silicate binding agent is added. 3. The additive according to at least one possible embodiment consisting of or consisting essentially of or comprising a suspension with nano$SiO_2$, and micro$SiO_2$ plus water is added to the basic mixture.

The mixing time depends on the type of mixing aggregate used and has to be determined experimentally. The minimum or minimized mixing time for the mixture to achieve the condition aimed at (homogenization or uniform distribution) may be determined.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Examples Carried Out

The basic mixture used in the tests was Haltern mold sand. Below, the experimental procedure will be explained by means of a comparison with a classic binding agent system.

a) Improvement in Flowability

To explain the improved flowability, which was achieved by jointly adding nano$SiO_2$ (0.01-0.05 μm) and micro$SiO_2$ (1-5 μm), the following test results were compared.

1. the basic mixture without the suspension according to at least one possible embodiment, hereafter also referred to as additive C;

2. the basic mixture with suspension which is composed of a suspension consisting of or consisting essentially of or comprising 25% nano$SiO_2$, 25% micro$SiO_2$ and 50% water, and 3. the basic mixture with a quantity of water equivalent to the suspension.

The term "basic mixture" indicates a mixture of mold sand, NaOH and alkali silicate binding agent in changing compositions.

1. Basic Mixture of a Classic Binding Agent System Haltern mold sand determined by Brunhuber p. 400

| | | |
|---|---|---|
| NaOH | 0.20% | |
| Alkali silicate binding agent | 1.80% | GF flowability 73% |
| Additive: | — | |

GF flowability determined according to Brunhuber p, 352.353

$$F+[(h1-h)/(h1-h2)]*100\%$$

2. Basic Mixture+Suspension

| | | |
|---|---|---|
| NaOH | 0.20% | |
| Alkali silicate binding agent | 1.80% | GF flowability 87% |
| Additive C* | 1.00% | |

(Additive C: suspension of 25% nano$SiO_2$, 25% micro$SiO_2$ and 50% water, with the nano-$SiO_2$ spheres comprising a mean diameter of 0.03 μm and with the micro$SiO_2$ spheres having a mean diameter of 3 μm).

3. Basic Mixture and a Quantity of Water Equivalent to the Suspension

| | | |
|---|---|---|
| NaOH | 0.20% | |
| Alkali silicate binding agent | 1.80% | GF flowability 73% |
| Water | 0.50% | |

Figure 1:
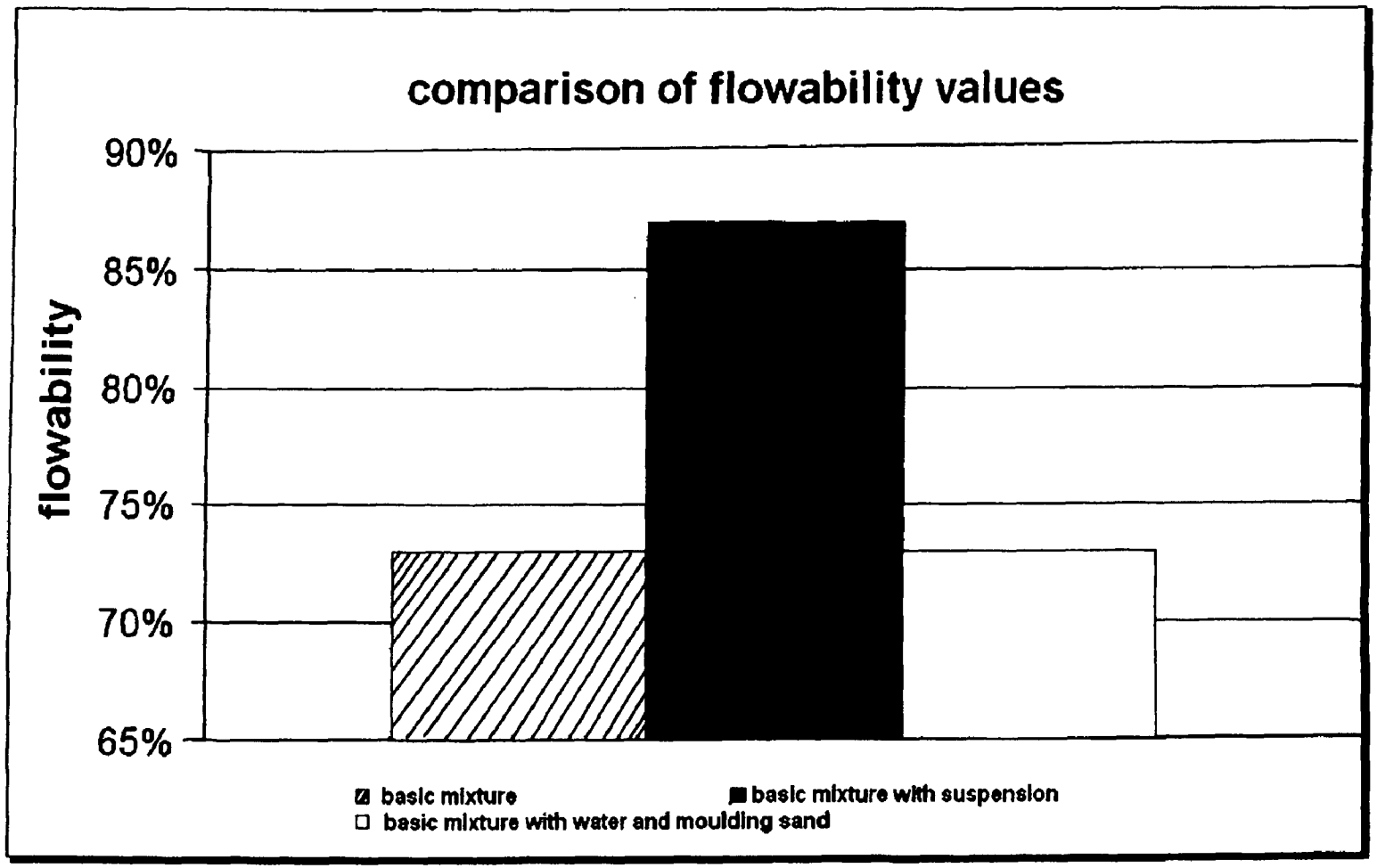
FIG. 1 is a bar graph showing comparison of flowability values.

FIG. 1 shows the listed results graphically. When the test results are compared, it can be seen quite clearly that the suspension results in an improvement in flowability. Furthermore, it is clear that the addition of a quantity of water equivalent to the suspension does not exert any influence on flowability.

To permit a comparison with prior art processes, molding material mixtures such as they are described in DE '535 of AS Luegen and in EP '719 were produced with the same basic mixture and tested as described above. The results are graphically illustrated in FIG. 7, with the comparative examples having been selected according to FIG. 6.

| Mixture<br>Basic Mixture | Flowability |
|---|---|
| Binding agent system according to EP '719 | 73% |
| Molding material mixture acc. to DE '535 | 80% |
| Basic mixture + additive C | 87% |

Figure 7:
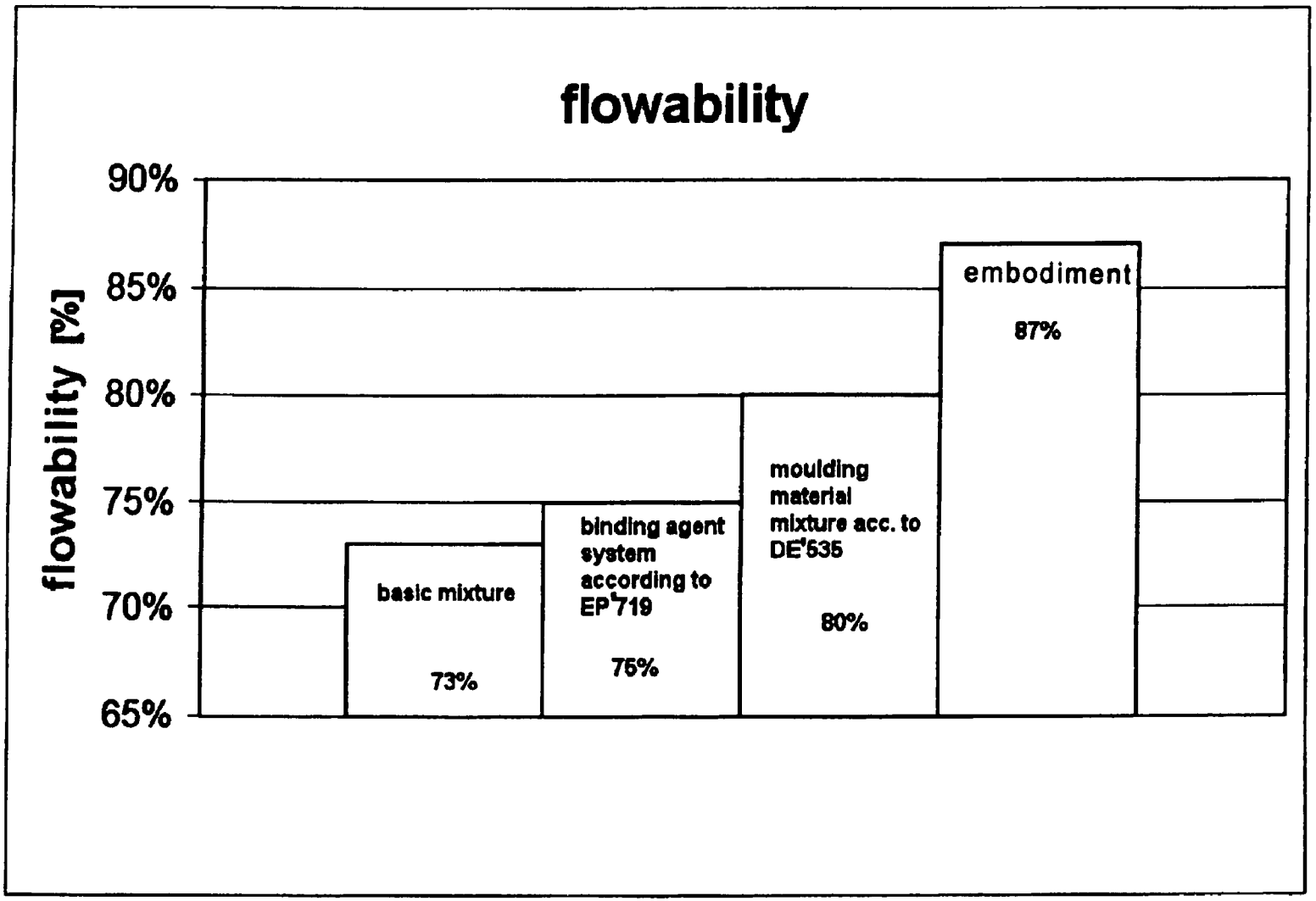
FIG. 7 is a bar graph showing flowability.

FIG. 7 shows that by adding, in accordance with the invention, $SiO_2$ spheres present in two grain classifications, the flowability (according to GF) of the core sand increases. The micro$SiO_2$ spheres are spaced by the nano$SiO_2$ and permit the so-called "roller skate effect", i.e. the sand grains roll off as a result of the micro$SiO_2$ spheres arranged between them.

b) Increase in Bending Strength

1. Basic Mixture

| | |
|---|---|
| NaOH | 0.20% |
| Alkali silicate binding agent | 1.40% |
| Additive | — |

Bending Strength

| | |
|---|---|
| Removal strength: | 289 N/cm$^2$ |
| Core storage time 1 h: | 284 N/cm$^2$ |
| Core storage time 3 h: | 281 N/cm$^2$ |
| Core storage time 24 h: | 287 N/cm$^2$ |

2. Basic Mixture+Additive C

| | |
|---|---|
| NaOH | 0.20% |
| Alkali silicate binding agent | 1.40% |
| Additive C* | 1.00% |

*(Additive C: Suspension of 25% nano$SiO_2$, 25% micro$SiO_2$ and 50% water).

Bending Strength

| | |
|---|---|
| Removal strength: | 475 N/cm$^2$ |
| Core storage time 1 h: | 483 N/cm$^2$ |
| Core storage time 3 h: | 476 N/cm$^2$ |
| Core storage time 24 h: | 475 N/cm$^2$ |

Figure 2:
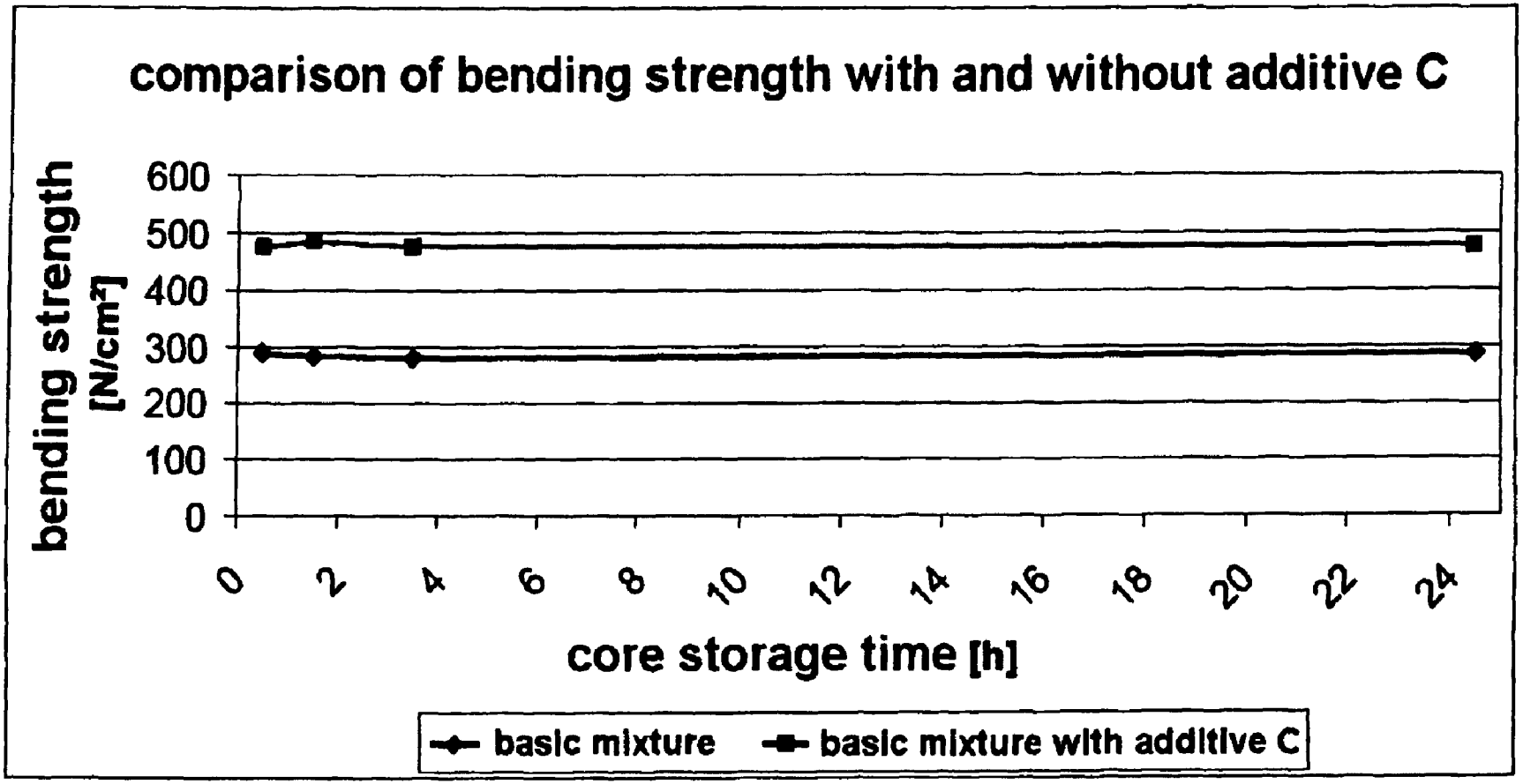
FIG. 2 is a line graph showing comparison of bending strength with and without an additive according to at least one possible embodiment.

The determined bending strength values are graphically illustrated in FIG. 2. A comparison between the bending strength of a basic core sand mixture without additive C and the bending strength of a basic core sand mixture with the additive C (suspension of 25% nano$SiO_2$, 25% micro$SiO_2$ and 50% water) clearly shows that by adding an additive in accordance with at least one possible embodiment, the bending strength is increased by ⅔.

c) Increase in Precipitation Speed

1. Basic Mixture

| | |
|---|---|
| NaOH | 0.20% |
| Alkali silicate binding agent | 1.40% |
| Additive | — |

| | Removal strength | Removal strength | Removal strength |
|---|---|---|---|
| 1st test bar (after 25 sec) | 64 N/cm$^2$ | 65 N/cm$^2$ | 65 N/cm$^2$ |
| 2nd test bar (after 50 sec) | 62 N/cm$^2$ | 65 N/cm$^2$ | 64 N/cm$^2$ |
| 3rd test bar (after 75 sec) | 63 N/cm$^2$ | 64 N/cm$^2$ | 65 N/cm$^2$ |

2. Basic Mixture+Additive C

| | |
|---|---|
| NaOH | 0.20% |
| AWB-AL binding agent | 1.40% |
| Additive C* | 1.00% |

(Additive C: suspension of 25% nano$SiO_2$ and 25% micro$SiO_2$ and 50% water)

| | Removal strength | Removal strength | Removal strength |
|---|---|---|---|
| 1st test bar (after 25 sec) | 81 N/cm$^2$ | 84 N/cm$^2$ | 80 N/cm$^2$ |
| 2nd test bar (after 50 sec) | 95 N/cm$^2$ | 92 N/cm$^2$ | 95 N/cm$^2$ |

-continued

| | Removal strength | Removal strength | Removal strength |
|---|---|---|---|
| 3rd test bar (after 75 sec) | 109 N/cm$^2$ | 102 N/cm$^2$ | 105 N/cm$^2$ |

Figure 3:
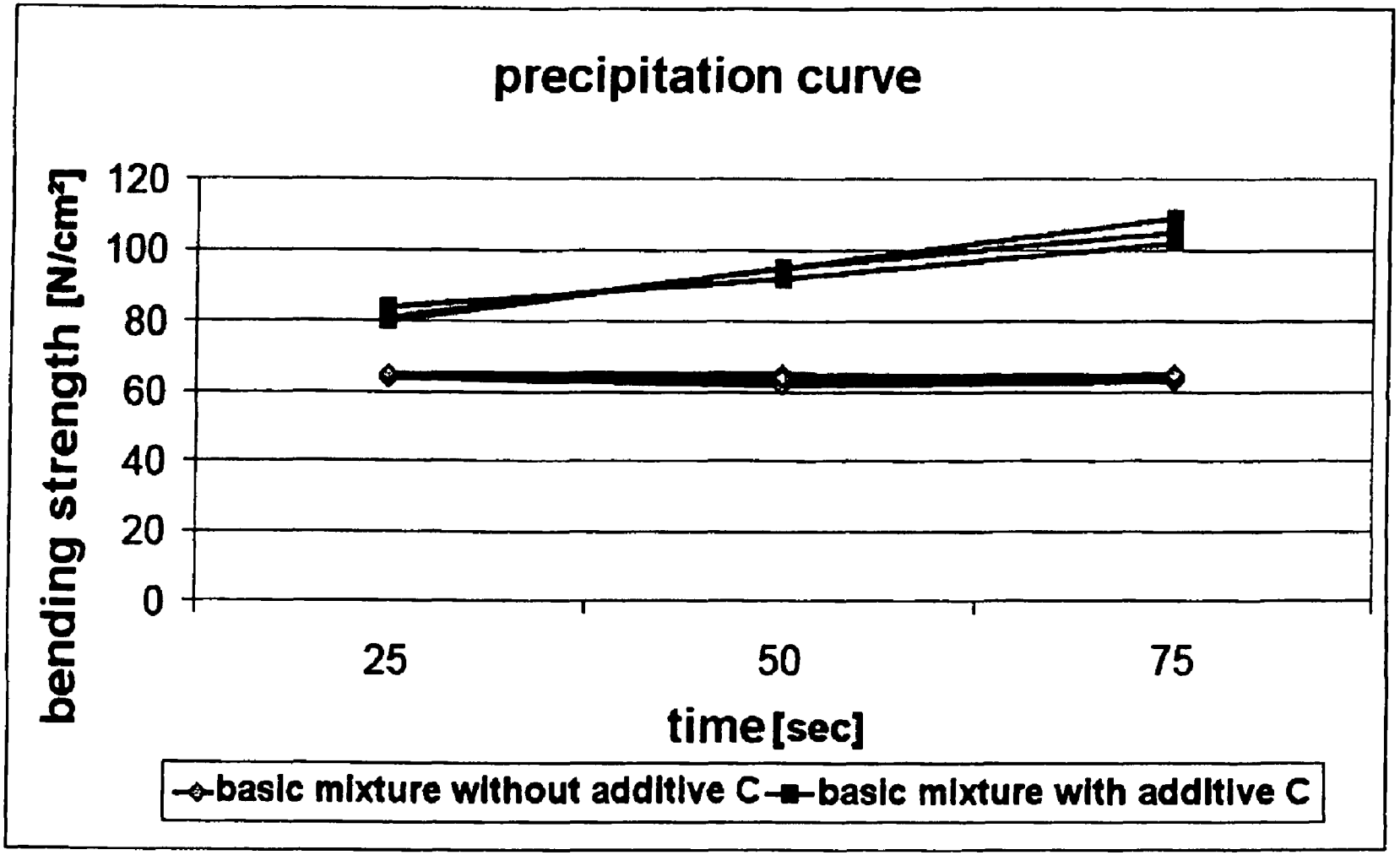
FIG. 3 is a line graph showing precipitation curves.

The test results are graphically illustrated in FIG. 3. Due to the present test rig system, the three simultaneously produced test bars could be tested only individually and at intervals of approximately 25 seconds.

During the determination of the bending strength of the basic mixture, this difference in time is not taken into account either, i.e. the strength of all three test bars was approximately the same. However, when testing the test bars containing additive C, it was found that the bending strength continuously increases during the test procedure (from the first to the second test bar.)

d) Reduction in Sensitivity to Air Humidity

1. Basic Mixture

| | |
|---|---|
| NaOH | 0.20% |
| Alkali silicate binding agent | 2.40% |
| Silicone oil | 0.10% |

| Core storage time [h] (Storage in moisture cabinet) | Bending strength with Microwave drying | Bending strength without Microwave drying |
|---|---|---|
| 0 | 289 N/cm$^2$ | 57 N/cm$^2$ |
| 1 | 240 N/cm$^2$ | 86 N/cm$^2$ |
| 3 | 200 N/cm$^2$ | 50 N/cm$^2$ |
| 24 | 25 N/cm$^2$ | 22 N/cm$^2$ |

2. Basic Mixture+Additive C

| | |
|---|---|
| NaOH | 0.20% |
| Alkali silicate binding agent | 1.40% |
| Additive C* | 1.00% |

(Additive C: Suspension of 25% nano$SiO_2$, 25% micro$SiO_2$ and 50% water).

| Basic Mixture with Additive C | | |
|---|---|---|
| Core storage time [h] (Storage in moisture cabinet) | Bending strength with Microwave drying | Bending strength without Microwave drying |
| 0 | 475 N/cm$^2$ | 87 N/cm$^2$ |
| 1 | 409 N/cm$^2$ | 106 N/cm$^2$ |
| 3 | 303 N/cm$^2$ | 73 N/cm$^2$ |
| 24 | 85 N/cm$^2$ | 87 N/cm$^2$ |

Figure 4:
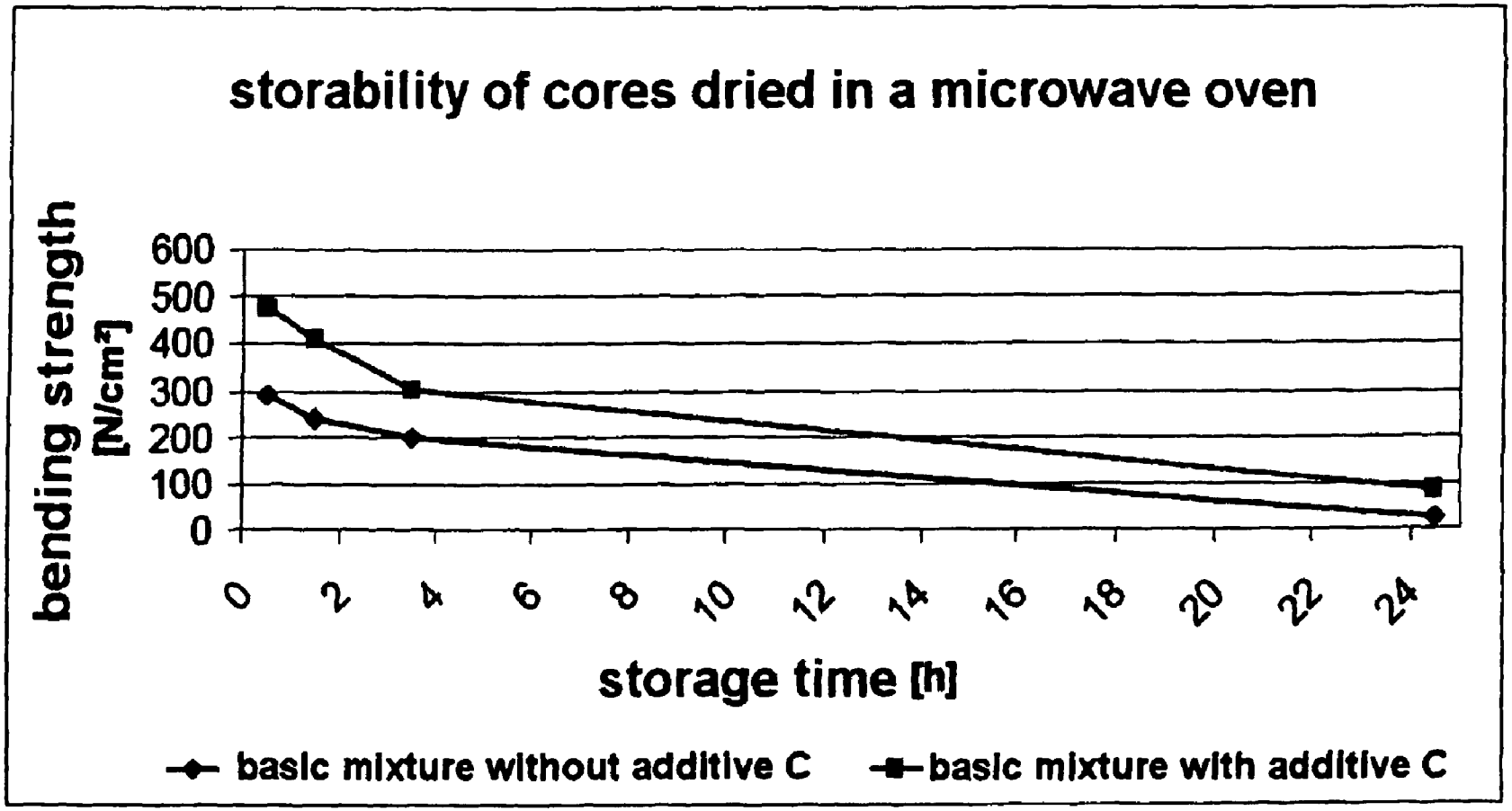
FIG. 4 is a line graph showing storability of cores dried in a microwave oven.
Figure 5:
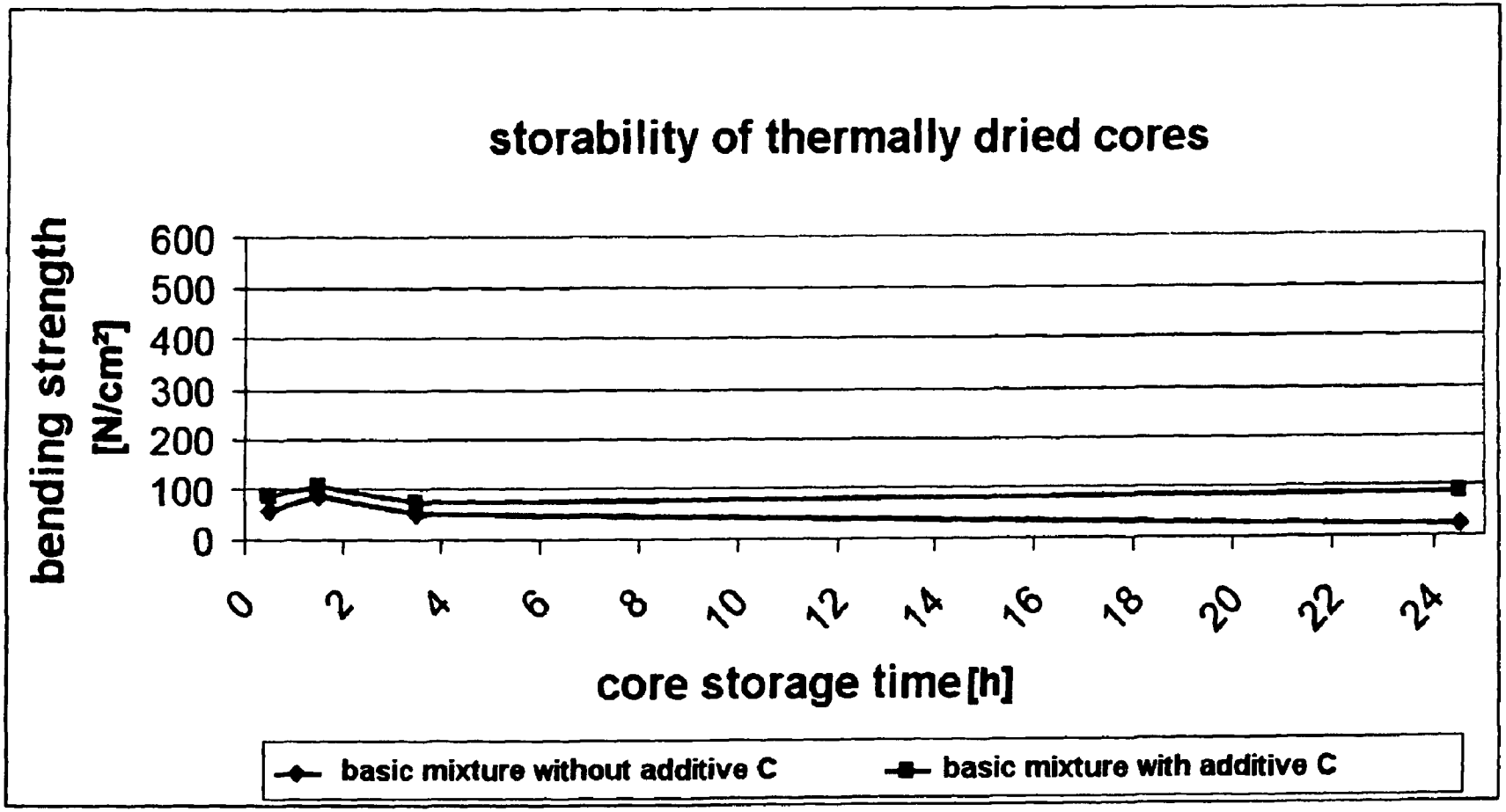
FIG. 5 is a line graph showing storability of thermally dried cores.

The test results are graphically illustrated in FIGS. 4 and 5. To be able to assess the storability of the cores, even under extreme conditions (air humidity 78%, temperature 33° C.), the cores were stored in a moisture cabinet.

FIGS. 4 and 5 give the evaluation which shows that additive C has a positive effect on storability.

This effect is particularly obvious if the cores were not dried in a microwave oven (FIG. 5).

e) Comparing the Surfaces of Several Castings in Respect of Sand Adhesions

Figure 6:
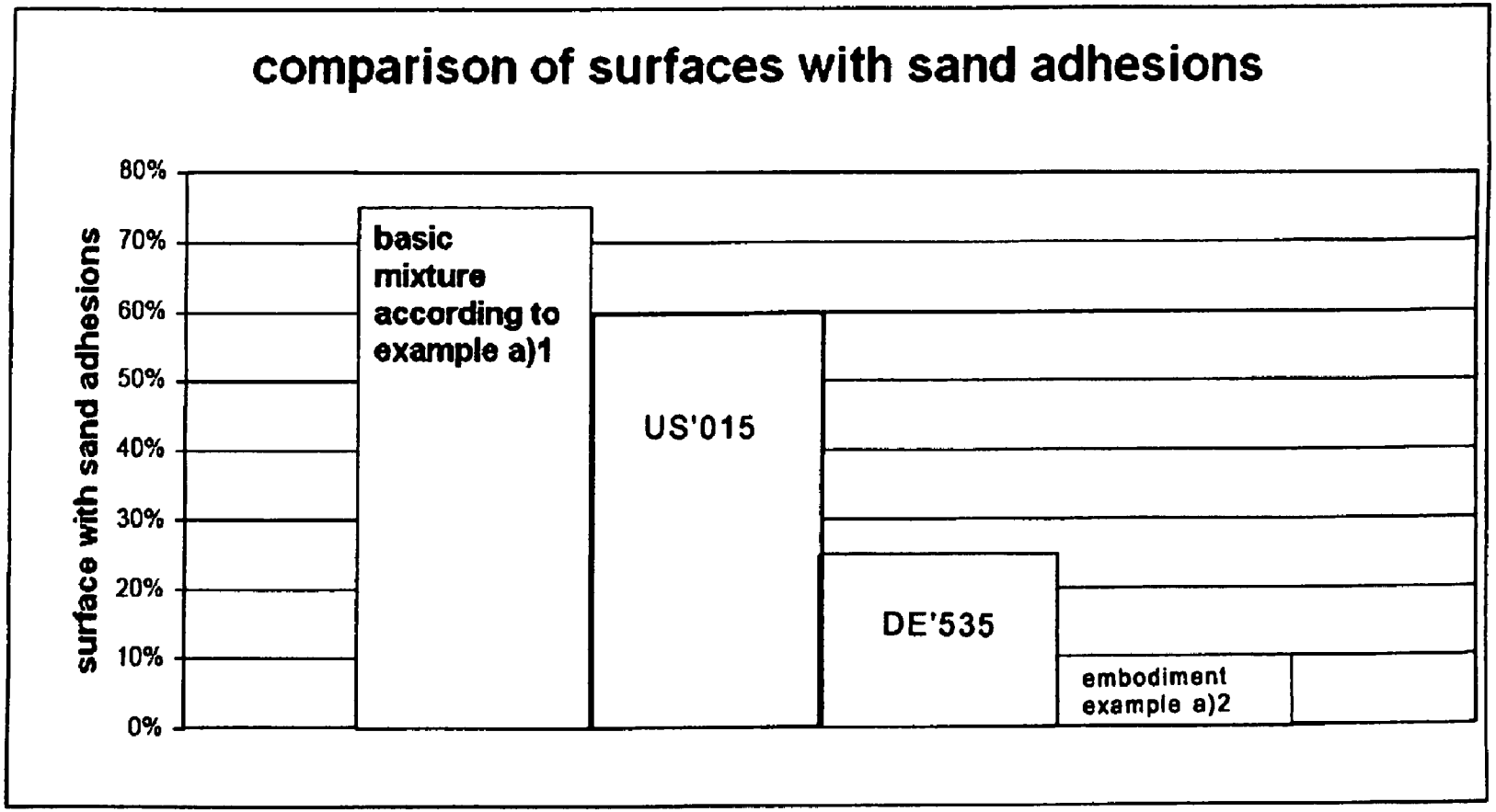
FIG. 6 is a bar graph showing comparison of surfaces with sand adhesions.

Explanatory Notes Regarding FIG. 6:

For determining the quality of casting surfaces, use was made of trough-shaped cores having the dimensions 150 mm×80 mm. The core was mixed out of the molding material to be tested in a laboratory vane mixer (Duomix 1) of Vogel and Schemmann AG (Schwerter Strasse 200, D-58099 Hagen, Germany) and distributed by Giessereimaschinen Steffens GmbH (Gutenbergstrasse 3, D-47443 Moers, Germany). First the quartz sand was provided and stirred with first NaOH and then water glass being added. After the mixture was stirred for 1 minute, there was added the amorphous silicon dioxide (examples in accordance with the invention) and, for the comparative examples, a polyphosphate solution (according to U.S. Pat. No. 5,641,015 or amorphous $SiO_2$ in the form of spheres, according to '535) was added while stirring continued. Subsequently, the mixture continued to be stirred by one more minute.

The molding material mixtures were transferred into the storage bunker of a hot box core casting machine (Core shooter Roeper Model H2.5) of Roeperwerk Giessereimaschinen GmbH (Eindhoven Strasse 58, D-41751 Viersen-Duelken, Germany) whose molding tool was heated to 180° C. The molding material mixtures were introduced by compressed air (5 bar) into the molding tool and remained in the molding tool for a further period of 35 seconds. The molding tool was opened and the molded part removed. In order to promote maximized strength, the molded part is re-dried in the microwave oven. Subsequently, the casting was cast by open-hand casting.

After the casting had cooled, the molded part was removed and the casting surface was assessed in respect of type and quantity of sand adhesions.

| Casting parameters: | |
|---|---|
| Casting dimensions: | 150 × 80 × 40 mm |
| Casting weight: | 900 g |
| Alloy used: | AlSi 7 mg |
| Casting temperature: | 740° C. |
| Static casting height: | 200 mm |

| Measured sand adhesions in surface percent with reference to the respective surface | |
|---|---|
| Mixture | Surface with sand adhesions |
| Basic mixture without additive | 75% |
| Basic mixture with percentage of polyphosphate & borate | 60% (US '015) |
| Basic mixture with glass pearls, thickness 100-200 μm, according to Table 5 Nr. 3.7 of AS Lüngen DE 102004042535 | 25% (DE '535) |
| Basic mixture according to at least one embodiment with widely spread grain spectrum | <10% embodiment according to example a)2 |

Figure 8:
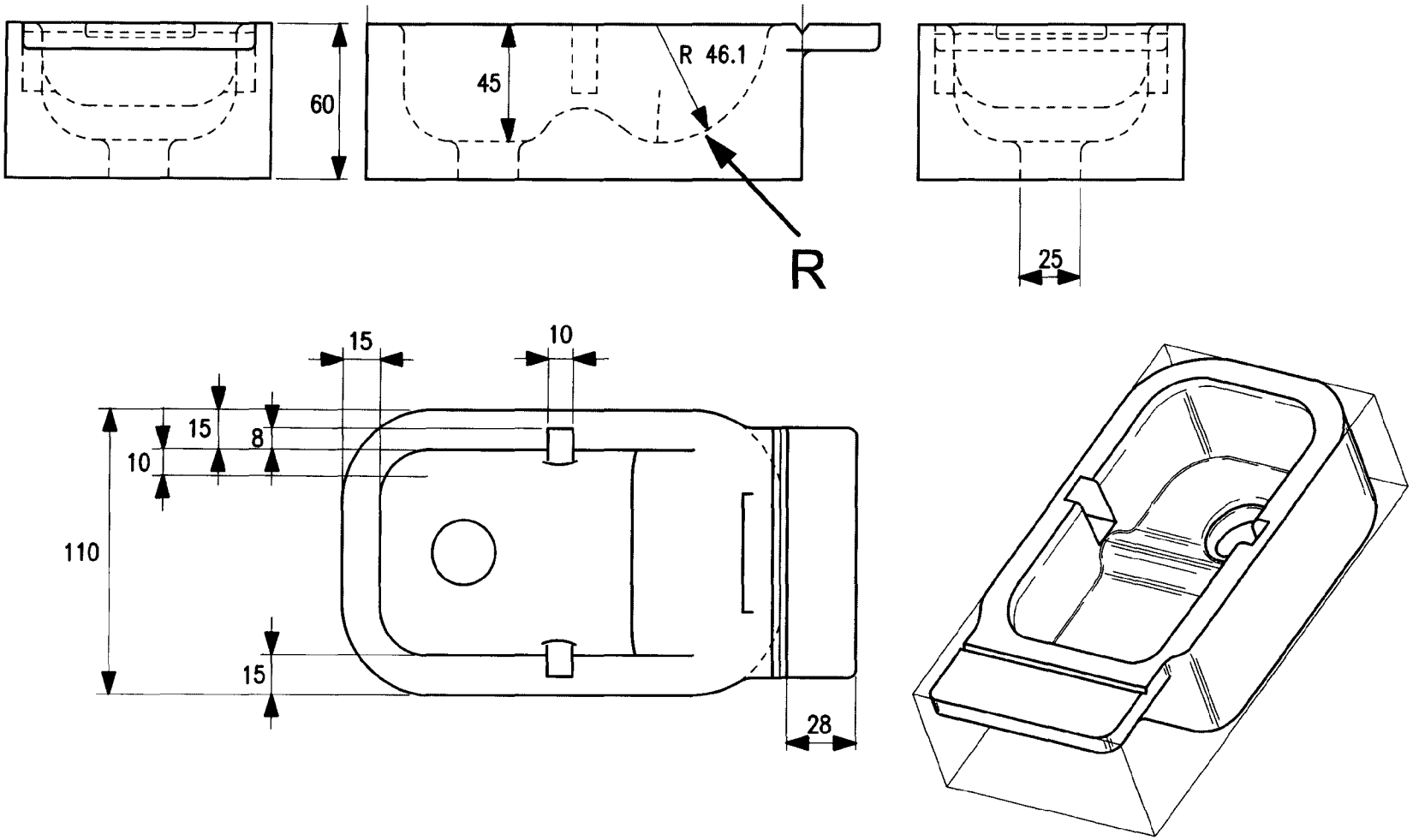
FIG. 8 shows a molded part in accordance with at least one possible embodiment.

FIG. 8 illustrates the molded part which was used to produce the casting used in this case. The percentages of said adhesions refer to the outer surface in the region of the curved casting region R which occurs as a continuously curved bulge R in the molded part.

FIG. 6 graphically illustrates the test results. The molding material mixture in accordance with the invention achieves a clearly improved casting surface as compared to the basic mixture according to example A)1, according to US '015 (amorphous $SiO_2$ spheres built up of nano particles) and according to DE '535 (amorphous, synthetic silicic acid in spherical form).

One feature or aspect of an embodiment is believed at the time of the filing of this patent application to possibly reside broadly in a molding material mixture for foundry purposes, consisting of a mold sand, a sodium hydroxide aqueous solution, a binding agent based on alkali silicate and additives, characterized in that the mold sand particles comprise a grain size of 0.1 to 1 mm, that the molding material mixture contains 0.1 to 10 percent by weight of sodium hydroxide aqueous solution with reference to the weight of the sand, wherein the sodium hydroxide aqueous solution comprises a concentration of 20 to 40 percent by weight, that the molding material mixture contains 0.1 to 5% of binding agent based on alkali silicate with a solid matter percentage of 20 to 70%, that the molding material mixture, as the additive, contains 0.1 to 3 percent by weight of a suspension with a solid matter percentage of 30 to 70% of amorphous, spherical $SiO_2$ in two grain size classifications in the suspension with a first grain size classification A containing $SiO_2$ particles with a grain size ranging between 1 and 5 micrometers and with a second grain size classification B containing $SiO_2$ particles with a grain size ranging between 0.01 and 0.05 micrometers and wherein, for the volume percentages of the two grain size ranged A, B, the following distribution rule applies: 0.8 to 1.0-1.2 to 1.

Another feature or aspect of an embodiment is believed at the time of the filing of this patent application to possibly reside broadly in a molded part for foundry purposes, produced from a molding material mixture, characterized in that the surface of the individual mold sand grain in the molding part comprises a primary structure out of $SiO_2$ particles with a grain size ranging between 1 and 5 micrometers wherein the micrometer-sized amorphous $SiO_2$ spheres space the individual quartz sand particles from one another and further characterized by a substructure of $SiO_2$ particles with a grain size ranging between 0.01 and 0.05 micrometers which are distributed in a binding agent layer which is 0.5 to 2 micrometers thick and is uniformly distributed on mold sand grains, wherein the nanometer-sized, amorphous $SiO_2$ spheres form adjoining peaks and valleys of up to 300 nanometers of height/depth.

Yet another feature or aspect of an embodiment is believed at the time of the filing of this patent application to possibly reside broadly in a process of producing a molded part, characterized in the molding said is provided, mixed with the sodium hydroxide aqueous solution, laced with the binding agent based on alkali silicate, with the binding agent then being uniformly and homogeneously distributed over all the mold sand grains in the form of a binding agent envelope; that, into the binding agent envelope there is fed a mixture of $SiO_2$ particles with two grain size classifications and that the molding material mixture is dried to form a molded part, wherein the binding agent envelope shrinking during the drying process, forming a roughness structure with a maximum height differential of 300 nanometers.

Still another feature or aspect of an embodiment is believed at the time of the filing of this patent application to possibly reside broadly in a process, characterized in that 0.10 to 0.30% of sodium hydroxide aqueous solution is mixed with mold sand, that then 1 to 4% of binding agent on alkali silicate basis is added and that the binding agent is uniformly and homogeneously distributed over the mold sand grains in the form of a binding agent envelope with a thickness of 0.5 to 2 micrometers.

A further feature or aspect of an embodiment is believed at the time of the filing of this patent application to possibly reside broadly in a process, characterized in that, during the drying process, the binding agent envelope shrinks by 50 to 70 percent by volume.

Another feature or aspect of an embodiment is believed at the time of the filing of this patent application to possibly reside broadly in a process, characterized in that the drying process is a physical one, wherein the binding agent envelope is pre-shrunk by 40 to 60 percent by volume and wherein the remaining shrinking process takes place thermally.

Yet another feature or aspect of an embodiment is believed at the time of the filing of this patent application to possibly reside broadly in a process, characterized in that the drying process takes place in a microwave oven.

One feature or aspect of an embodiment is believed at the time of the filing of this patent application to possibly reside broadly in a molding material mixture for foundry purposes, comprising the following components: a mold sand; 0.1 to 10 percent by weight of a sodium hydroxide aqueous solution; 0.1 to 5 percent by weight of an alkali-silicate binding agent; and 0.1 to 3 percent by weight of an additive suspension; wherein: said mold sand comprises mold sand particles having a grain size of 0.1 to 1 mm; said sodium hydroxide aqueous solution comprises a concentration of 20 to 40 percent by weight of sodium hydroxide; said alkali-silicate binding agent comprises 20 to 70 percent by volume of alkali-silicate; said additive suspension comprises 30 to 70 percent by volume of amorphous, spherical $SiO_2$ particles; each of said amorphous, spherical $SiO_2$ particles having one of: a first grain size in the range of between 1 and 5 micrometers; and a second grain size in the range of between 0.01 and 0.05 micrometers; and the volumetric amount of amorphous, spherical $SiO_2$ particles having the first grain size is in the range of 0.8 to 1.2 times the volumetric amount of amorphous, spherical $SiO_2$ particles having the second grain size.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

This application further relates to a molding material mixture for foundry purposes, consisting of or comprising a mold sand, a sodium hydroxide aqueous solution, a binding agent based on alkali silicate and additives, wherein the mold sand particles comprise a grain size of 0.1 to 1 mm. The molding material mixture contains 0.1 to 10 percent by weight of sodium hydroxide aqueous solution with reference to the weight of the sand and 0.1 to 5% of binding agent based on alkali silicate with a solid matter percentage of 20 to 70%, wherein the molding material mixture, as the additive, contains 0.1 to 3 percent by weight of a suspension with a solid matter percentage of 30 to 70% of amorphous, spherical $SiO_2$. The amorphous, spherical $SiO_2$ is contained in the suspension in two grain size classifications with a first grain size classification A containing $SiO_2$ particles with a grain size ranging between 1 and 5 micrometers and with a second grain size classification B containing $SiO_2$ particles with a grain size ranging between 0.01 and 0.05 micrometers. For the volume percentages of the two grain size ranges A, B, the following distribution rule applies: 0.8 to 1.0-1.2 to 1.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that any or all the examples of patents, published patent applications, and other documents which are included in this application and including those which are referred to in paragraphs which state "Some examples of . . . which may possibly be used in at least one possible embodiment of the present application . . . " may possibly not be used or useable in any one or more or any embodiments of the application.

The sentence immediately above relates to patents, published patent applications and other documents either incorporated by reference or not incorporated by reference.

The corresponding foreign patent publication application, namely, Federal Republic of Germany Patent Application No. 10 2007 027 577.5, filed on Jun. 12, 2007, having inventors Ralf-Joachim GERLACH and Bettina WEHREN, and DE-OS 10 2007 027 577.5 and DE-PS 10 2007 027 577.5, is hereby incorporated by reference as if set forth in their entirety herein for the purpose of correcting and explaining any possible misinterpretations of the English translation thereof. In addition, the published equivalents of the above corresponding foreign patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A molding material mixture for foundry purposes, comprising the following components:

a mold sand;

0.1 to 10 percent by weight of a sodium hydroxide aqueous solution;

0.1 to 5 percent by weight of an alkali-silicate binding agent; and 0.1 to 3 percent by weight of an additive suspension;

wherein:

said mold sand comprises mold sand particles having a grain size of 0.1 to 1 mm;

said sodium hydroxide aqueous solution comprises a concentration of 20 to 40 percent by weight of sodium hydroxide;

said alkali-silicate binding agent comprises 20 to 70 percent by volume of alkali-silicate;

said additive suspension comprises 30 to 70 percent by volume of amorphous, spherical $SiO_2$ particles;

each of said amorphous, spherical $SiO_2$ particles having one of:

a first grain size in the range of between 1 and 5 micrometers; and a second grain size in the range of between 0.01 and 0.05 micrometers; and the volumetric amount of amorphous, spherical $SiO_2$ particles having the first grain size is in the range of 0.8 to 1.2 times the volumetric amount of amorphous, spherical $SiO_2$ particles having the second grain size.

2. A molded part for foundry purposes, produced from a molding material mixture according to claim 1, wherein:

the surface of the individual mold sand grain in the molded part comprises a primary structure out of $SiO_2$ particles with a grain size ranging between 1 and 5 micrometers;

the micrometer-sized amorphous $SiO_2$ spheres space the individual quartz sand particles from one another;

the molded part comprises a substructure of $SiO_2$ particles with a grain size ranging between 0.01 and 0.05 micrometers which are distributed in a binding agent layer which is 0.5 to 2 micrometers thick and is uniformly distributed on mold sand grains;

the nanometer-sized, amorphous $SiO_2$ spheres form adjoining peaks and valleys of up to 300 nanometers of height/depth.

3. A method of producing a molded part according to claim 2, wherein the molding sand is provided, mixed with the sodium hydroxide aqueous solution, laced with the binding agent based on alkali silicate, with the binding agent then being uniformly and homogeneously distributed over all the mold sand grains in the form of a binding agent envelope; that, into the binding agent envelope there is fed a mixture of $SiO_2$ particles with two grain size classifications and that the molding material mixture is dried to form a molded part, wherein the binding agent envelope shrinking during the drying process, forming a roughness structure with a maximum height differential of 300 nanometers.

4. The process according to claim 3, wherein 0.10 to 0.30% of sodium hydroxide aqueous solution is mixed with mold sand, then 1 to 4% of binding agent on alkali silicate basis is added and the binding agent is uniformly and homogeneously distributed over the mold sand grains in the form of a binding agent envelope with a thickness of 0.5 to 2 micrometers.

5. The process according to claim 4, wherein, during the drying process, the binding agent envelope shrinks by 50 to 70 percent by volume.

6. The process according claim 5, wherein the drying process is a physical one, and wherein the binding agent envelope is pre-shrunk by 40 to 60 percent by volume and wherein the remaining shrinking process takes place thermally.

7. The process according to claim 6, wherein the drying process takes place in a microwave oven.

8. A molding material mixture for use in a foundry, said molding material mixture consisting of a mold sand, a sodium hydroxide aqueous solution, a binding agent based on alkali silicate and additives, wherein the mold sand particles comprise a grain size of 0.1 to 1 mm, the molding material mixture contains 0.1 to 10 percent by weight of sodium hydroxide aqueous solution with reference to the weight of the sand, and wherein the sodium hydroxide aqueous solution comprises a concentration of 20 to 40 percent by weight, the molding material mixture contains 0.1 to 5% of binding agent based on alkali silicate with a solid matter percentage of 20 to 70%, the molding material mixture, as the additive, contains 0.1 to 3 percent by weight of a suspension with a solid matter percentage of 30 to 70% of amorphous, spherical $SiO_2$ in two grain size classifications in the suspension with a first grain size classification A containing $SiO_2$ particles with a grain size ranging between 1 and 5 micrometers and with a second grain size classification B containing $SiO_2$ particles with a grain size ranging between 0.01 and 0.05 micrometers, and wherein, the volumetric amount of amorphous, spherical $SiO_2$ particles having the first grain size is in the range of 0.8 to 1.2 times the volumetric amount of amorphous, spherical $SiO_2$ particles having the second grain size.

9. A molded part for foundry purposes, produced from a molding material mixture according to claim 8, wherein the surface of the individual mold sand grain in the molding part comprises a primary structure out of $SiO_2$ particles with a grain size ranging between 1 and 5 micrometers, and wherein the micrometer-sized amorphous $SiO_2$ spheres space the individual quartz sand particles from one another, and wherein the molded part comprises a substructure of $SiO_2$ particles with a grain size ranging between 0.01 and 0.05 micrometers which are distributed in a binding agent layer which is 0.5 to 2 micrometers thick and is uniformly distributed on mold sand grains, wherein the nanometer-sized, amorphous $SiO_2$ spheres form adjoining peaks and valleys of up to 300 nanometers of height/depth.

10. A process of producing a molded part according to claim 9, wherein the molding sand is provided, mixed with the sodium hydroxide aqueous solution, laced with the binding agent based on alkali silicate, with the binding agent then being uniformly and homogeneously distributed over all the mold sand grains in the form of a binding agent envelope; that, into the binding agent envelope there is fed a mixture of $SiO_2$ particles with two grain size classifications and that the molding material mixture is dried to form a molded part, wherein the binding agent envelope shrinking during the drying process, forming a roughness structure with a maximum height differential of 300 nanometers.

11. The process according to claim 10, wherein 0.10 to 0.30% of sodium hydroxide aqueous solution is mixed with mold sand, then 1 to 4% of binding agent on alkali silicate basis is added and the binding agent is uniformly and homogeneously distributed over the mold sand grains in the form of a binding agent envelope with a thickness of 0.5 to 2 micrometers.

12. The process according to claim 11, wherein, during the drying process, the binding agent envelope shrinks by 50 to 70 percent by volume.

13. The process according to claim 12, wherein the drying process is a physical one, and wherein the binding agent envelope is pre-shrunk by 40 to 60 percent by volume and wherein the remaining shrinking process takes place thermally.

14. The process according to claim 13, wherein the drying process takes place in a microwave oven.

15. The process according to claim 3, wherein, during the drying process, the binding agent envelope shrinks by 50 to 70 percent by volume.

16. The process according to claim 3, wherein the drying process is a physical one, and wherein the binding agent envelope is pre-shrunk by 40 to 60 percent by volume and wherein the remaining shrinking process takes place thermally.

17. The process according to claim 3, wherein the drying process takes place in a microwave oven.

18. The process according to claim 10, wherein, during the drying process, the binding agent envelope shrinks by 50 to 70 percent by volume.

19. The process according to claim 10, wherein the drying process is a physical one, and wherein the binding agent envelope is pre-shrunk by 40 to 60 percent by volume and wherein the remaining shrinking process takes place thermally.

20. The process according to claim 10, wherein the drying process takes place in a microwave oven.

* * * * *